US010759088B2

(12) United States Patent
Sekiya

(10) Patent No.: US 10,759,088 B2
(45) Date of Patent: Sep. 1, 2020

(54) CUTTING BLADE MOUNTING METHOD

(71) Applicant: DISCO CORPORATION, Tokyo (JP)

(72) Inventor: Kazuma Sekiya, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 45 days.

(21) Appl. No.: 16/013,029

(22) Filed: Jun. 20, 2018

(65) Prior Publication Data

US 2019/0001526 A1 Jan. 3, 2019
US 2020/0198183 A9 Jun. 25, 2020

(30) Foreign Application Priority Data

Jun. 30, 2017 (JP) ..... 2017-128148

(51) Int. Cl.
*B28D 5/00* (2006.01)
*B28D 5/02* (2006.01)
*B24B 53/06* (2006.01)

(52) U.S. Cl.
CPC ..... *B28D 5/0058* (2013.01); *B24B 53/06* (2013.01); *B28D 5/022* (2013.01); *B28D 5/0082* (2013.01)

(58) Field of Classification Search
CPC .... B28D 5/0058; B28D 5/0082; B28D 5/022; B24B 53/06
See application file for complete search history.

(56) References Cited

U.S. PATENT DOCUMENTS 7,661,183 B2 * 2/2010 Tomooka ..... B25B 9/00 29/270
9,636,844 B2 * 5/2017 Wakita ..... B26D 7/2621
2008/0313875 A1 * 12/2008 Tomooka ..... B25B 9/00 29/270
2015/0020666 A1 * 1/2015 Wakita ..... B26D 7/2621 83/401
2016/0207216 A1 * 7/2016 Nitta ..... B26D 7/2621
2016/0218023 A1 * 7/2016 Takenouchi ..... H01L 21/67092

FOREIGN PATENT DOCUMENTS

JP 2006218571 A 8/2006

* cited by examiner

*Primary Examiner* — Bayan Salone
(74) *Attorney, Agent, or Firm* — Greer Burns & Crain, Ltd.

(57) ABSTRACT

A cutting blade mounting method of sandwiching both side surfaces of an annular cutting blade by a first flange and a second flange, the first flange being mounted on an end of a spindle and having a suction hole sucking and holding a side surface of the cutting blade to a sandwiching surface of the first flange, includes: a cutting blade provisional holding step of sucking and holding the cutting blade to the first flange by making the cutting blade abut against the sandwiching surface of the first flange at a perfect circle position at which a center of the cutting blade coincides with an axis of the spindle, and making a suction force act on the suction hole; and a fixing step of fixing the cutting blade maintaining the perfect circle position in the cutting blade provisional holding step to the first flange by the second flange.

2 Claims, 5 Drawing Sheets

CUTTING BLADE MOUNTING METHOD

BACKGROUND OF THE INVENTION

Field of the Invention

The present invention relates to a method of mounting a cutting blade in a cutting apparatus.

Description of the Related Art

In manufacture of semiconductor devices or the like, a plurality of sections are set by planned dividing lines formed in a lattice manner on a top surface of a wafer, a device such as an large scale integrated circuit (LSI) or an integrated circuit (IC) is formed in each section, and the wafer is divided into individual devices by performing cutting processing along the planned dividing lines by a cutting apparatus provided with a cutting blade. The cutting apparatus includes at least a chuck table holding the wafer and a cutting unit having a spindle that rotatably supports the cutting blade. The cutting blade is rotated via the spindle, and the wafer held on the chuck table is cut by the cutting blade.

When the axis of the spindle in the cutting unit and the rotational center of the cutting blade mounted on the spindle are even slightly eccentric to each other, the cutting blade vibrates in a direction orthogonal to the axis of the spindle, that is, a cutting direction, during high-speed rotation of the spindle mounted with the cutting blade. When the wafer is cut along the planned dividing lines in a state in which the cutting blade is vibrating, relatively large chips (chipping) occur on both sides of a cut groove, thus degrading device quality.

Particularly in a case where the cutting blade is a washer blade (hubless blade) formed by only an annular cutting edge, when the cutting blade is attached to a mount mounted on an end of the spindle, the cutting blade is mounted in a state in which the center of the cutting blade is slightly eccentric to the axis of the spindle due to the own weight of the cutting blade. Therefore, when replacement with the new cutting blade is performed, perfect circle setting dressing (perfect circle dressing) is performed which corrects the outer circumference of the cutting blade (see Japanese Patent Laid-Open No. 2006-218571, for example).

SUMMARY OF THE INVENTION

However, when the above-described perfect circle dressing is performed, the edge of the cutting blade is crushed. Thus, setting dressing for correcting the crushed edge needs to be performed next. Therefore, much time is needed for preparation (perfect circle dressing and setting dressing or the like) for making product cutting processing possible after the cutting blade is newly mounted.

It is accordingly an object of the present invention to provide a cutting blade mounting method that can mount a new cutting blade in a state in which a perfect circle is set.

In accordance with an aspect of the present invention, there is provided a cutting blade mounting method of sandwiching both side surfaces of a cutting blade formed by an annular cutting edge by sandwiching surfaces of a first flange and a second flange, and mounting the cutting blade onto a spindle, the first flange being mounted on an end of the spindle and having a suction hole sucking and holding a side surface of the cutting blade to the sandwiching surface, the cutting blade mounting method including: a cutting blade provisional holding step of sucking and holding the cutting blade to the first flange by making the cutting blade abut against the sandwiching surface of the first flange at a perfect circle position at which a center of the cutting blade coincides with an axis of the spindle, and making a suction force act on the suction hole; and a fixing step of fixing the cutting blade maintaining the perfect circle position to the first flange by the second flange after the cutting blade provisional holding step is performed.

According to the cutting blade mounting method in accordance with the present invention, the center of the cutting blade is set at the perfect circle position coinciding with the axis of the spindle in the cutting blade provisional holding step, and the fixing step is performed while the perfect circle position is maintained by suction. Consequently, eccentricity or the like of the cutting blade due to the own weight of the cutting blade does not occur, and the cutting blade is surely retained at the perfect circle position at a time of completion of the mounting.

According to the cutting blade mounting method in accordance with the present invention, a new cutting blade can be mounted in a state in which a perfect circle is set, and therefore an improvement in processing efficiency can be realized by shortening a time taken before cutting processing becomes possible.

The above and other objects, features and advantages of the present invention and the manner of realizing them will become more apparent, and the invention itself will best be understood from a study of the following description and appended claim with reference to the attached drawings showing a preferred embodiment of the invention.

DETAILED DESCRIPTION OF THE PREFERRED EMBODIMENT

Figure 1:
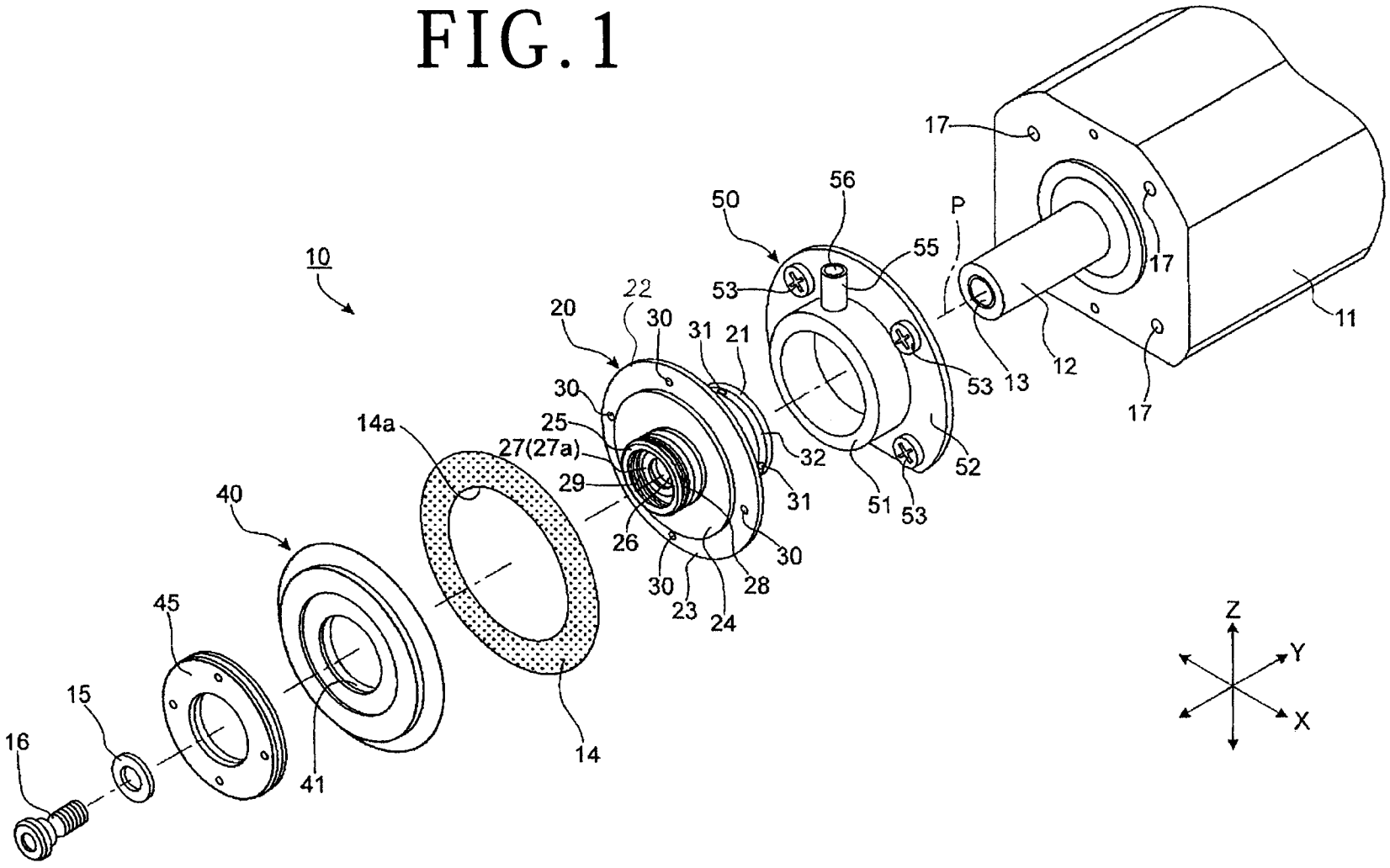
FIG. 1 is an exploded perspective view of a cutting unit.
Figure 2:
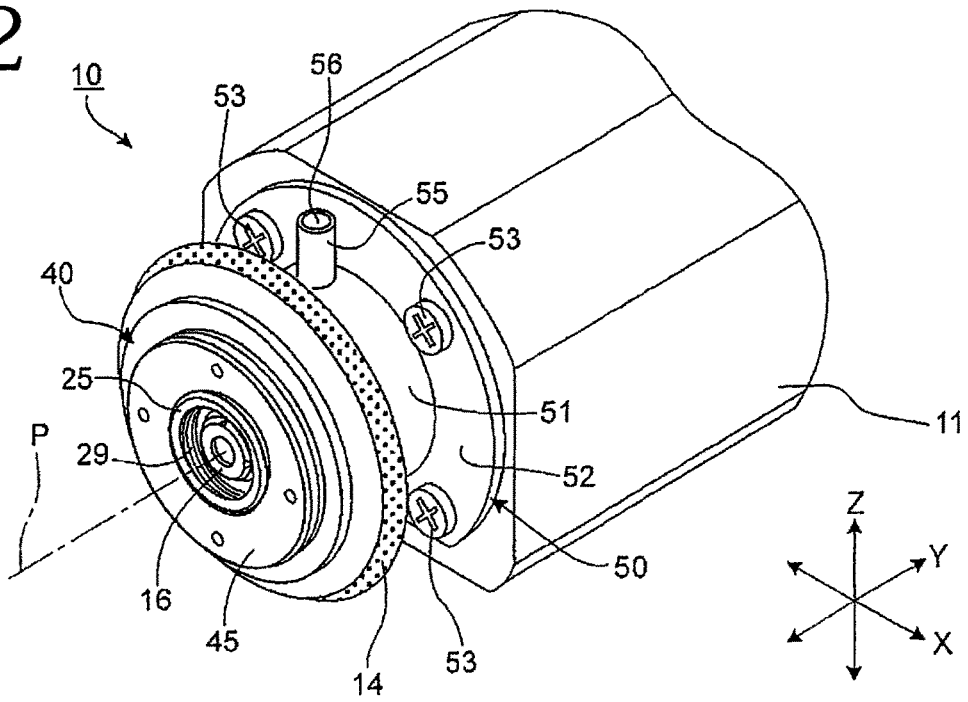
FIG. 2 is a perspective view of the cutting unit.

A mounting method and a mounting structure for a cutting blade according to a present embodiment will hereinafter be described with reference to the accompanying drawings. FIG. 1 depicts a state in which a cutting unit having a cutting blade is disassembled. FIG. 2 depicts the cutting unit in a completed state in which the cutting blade is mounted. FIGS. 3 to 6 depict steps for mounting the cutting blade.

The cutting unit 10 depicted in FIG. 1 and FIG. 2 constitutes a cutting apparatus. Though a general configuration of the cutting apparatus is not depicted, the cutting unit 10 is supported so as to be movable in a processing feed direction (X-axis direction), an indexing feed direction (Y-axis direction), and a raising or lowering direction (Z-axis direction) relative to a chuck table that holds workpiece (wafer) as a cutting object.

Figure 3:
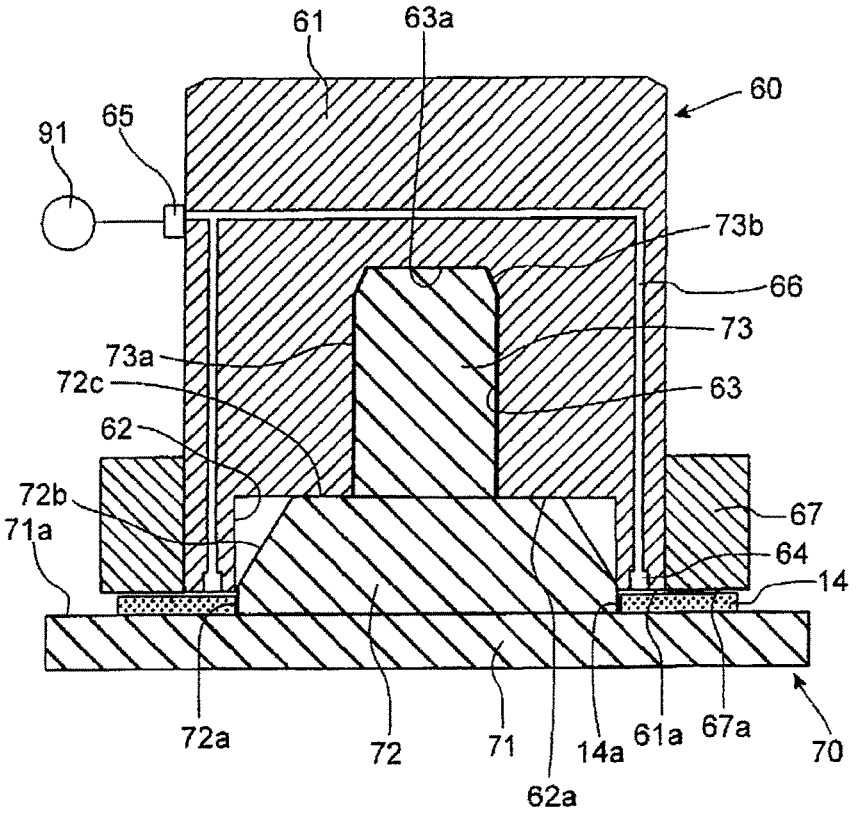
FIG. 3 is a sectional view depicting a state in which a cutting blade is held by a blade holding jig and a blade loading jig.
Figure 6:
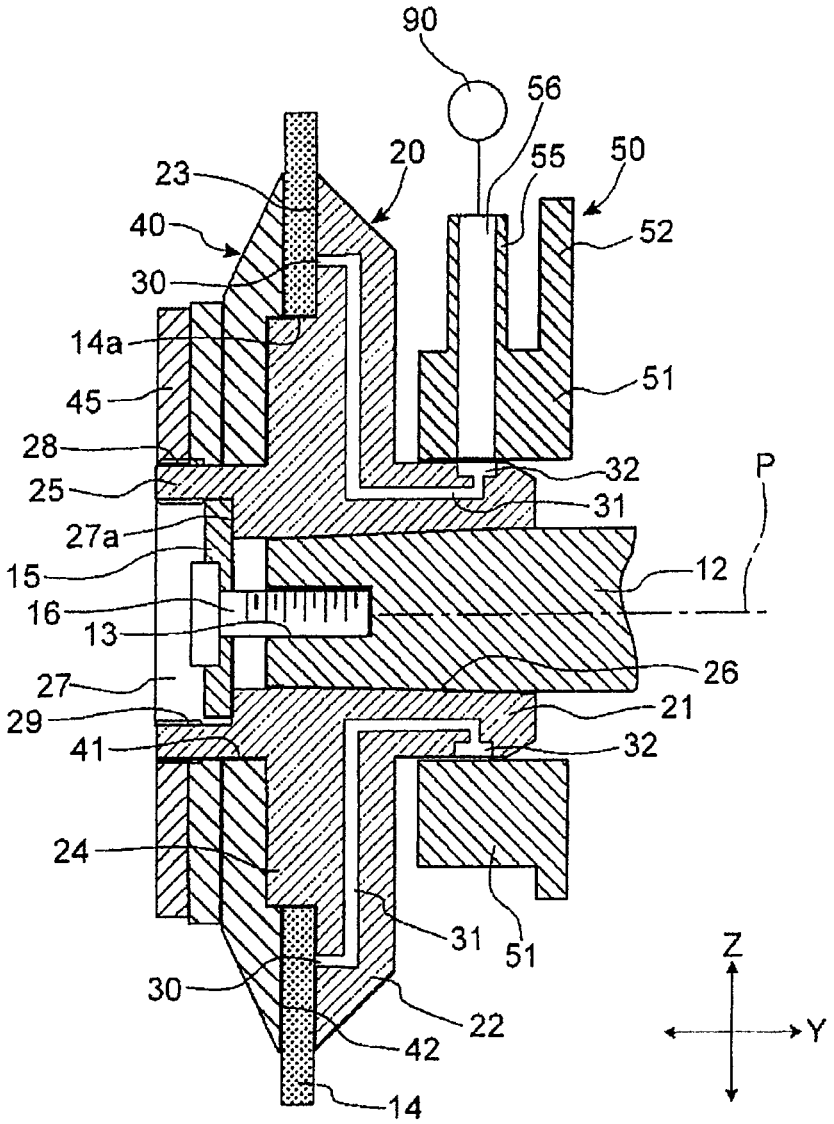
FIG. 6 is a sectional view depicting a state in which a fixing step of fixing the cutting blade is completed.

As depicted in FIG. 1, the cutting unit 10 has a spindle 12 supported so as to be rotatable, with respect to a spindle housing 11, about an axis P (represented by alternate long and short dashed lines in each figure except FIG. 3) of the spindle facing in the Y-axis direction. The spindle 12 has a tapered shape in which the diameter of an end part thereof is gradually decreased. A screw hole 13 is formed in an end surface of the spindle 12. As depicted in FIG. 6, the cutting blade 14 is sandwiched by a blade mounter 20 and a fixing flange 40, and mounted on an end portion of the spindle 12. When the spindle 12 is rotation-driven, the cutting blade 14 rotates, and performs cutting processing on the workpiece. A structure and a method for mounting the cutting blade 14 on the spindle 12 will be described in detail in the following. Incidentally, as for the blade mounter 20 and the fixing flange 40, a surface facing an opposite side from the spindle housing 11 in the Y-axis direction (surface facing in the same direction as the end surface of the spindle 12) will be set as a front surface, and a surface on a side facing the spindle housing 11 (surface facing a base end side of the spindle 12) will be set as a back surface.

The cutting blade 14 is a washer blade (hubless blade) formed by only an annular cutting edge. The cutting blade 14 is formed by solidifying diamond abrasive grains with a bonding agent. A circular opening 14*a* is formed on the inside of the cutting blade 14. An inner circumferential portion of the circular opening 14*a* is concentric with an outer circumferential portion of the cutting blade 14.

As depicted in FIG. 1 and FIG. 6, the blade mounter 20 includes a cylindrical portion 21 located on the back side and a flange 22 (first flange) projecting radially outward from the cylindrical portion 21. A sandwiching surface 23, a flange portion 24, and a boss portion 25 are formed on the front surface side of the flange 22. The sandwiching surface 23 is an annular surface located on an outer circumference side of the flange 22 and orthogonal to the Y-axis direction. The flange portion 24 is a circular projecting portion located on an inner circumference side of the sandwiching surface 23 and projecting to the front surface side. The diameter of the flange portion 24 is set slightly smaller than the inside diameter of the circular opening 14*a* of the cutting blade 14. In the vicinity of a front end of the boss portion 25, an external thread 28 is formed on an outer circumferential surface of the boss portion 25, and an internal thread 29 is formed on an inner circumferential surface of the boss portion 25 (see FIG. 1 and FIG. 6).

As depicted in FIG. 6, a fitting hole 26 and a circular recessed portion 27 communicating with each other in the Y-axis direction are formed in a center in a radial direction of the blade mounter 20. The fitting hole 26 is located on the back side, and opens to an end surface of the cylindrical portion 21. The circular recessed portion 27 is located on the front surface side, and opens to an end surface of the boss portion 25. The inside diameter of the circular recessed portion 27 is larger than the inside diameter of the fitting hole 26. A bottom surface 27*a* is formed within the circular recessed portion 27. An inner circumferential surface of the fitting hole 26 has a tapered shape in which the inside diameter of the inner circumferential surface of the fitting hole 26 is reduced toward the front surface side. The end part of the spindle 12 is inserted into the fitting hole 26 in a press-fitting state. Then, a washer 15 is inserted into the circular recessed portion 27 and made to abut against the bottom surface 27*a*, and a fixing bolt 16 is screwed into the screw hole 13 formed in the end surface of the spindle 12 and fastened. The blade mounter 20 is thereby fixed to the spindle 12 (see FIG. 6). In a state in which the blade mounter 20 is fixed, the center of the annular sandwiching surface 23 coincides with the axis P of the spindle.

As depicted in FIG. 6, the cutting blade 14 is mounted on the blade mounter 20 in a state in which the flange portion 24 is inserted in the circular opening 14*a* and one side surface of the cutting blade 14 abuts against the sandwiching surface 23. The mounting of the cutting blade 14 will be described later.

As depicted in FIG. 1, a plurality of suction holes 30 are formed at different positions in a rotational direction (circumferential direction) on the sandwiching surface 23 of the blade mounter 20. As depicted in FIG. 6, a plurality of suction passages 31 communicating with the respective suction holes 30 are formed within the blade mounter 20. Each of the suction passages 31 opens to a bottom surface of an annular groove 32 formed on an outer circumferential surface of the cylindrical portion 21. The annular groove 32 is a groove extending in a circumferential direction of the cylindrical portion 21, and is continuously formed over the whole circumference of the cylindrical portion 21.

The fixing flange 40 (second flange) has a fitting hole 41 having an inside diameter corresponding to the diameter of the boss portion 25 of the blade mounter 20. The fixing flange 40 is supported by the blade mounter 20 by inserting the boss portion 25 into the fitting hole 41. As depicted in FIG. 6, the back side of the fixing flange 40 is provided with an annular sandwiching surface 42 in a position opposed to the sandwiching surface 23 of the blade mounter 20. The boss portion 25 and the fitting hole 41 have shapes capable of relative movement in the Y-axis direction. The fixing flange 40 is inserted to a position at which the sandwiching surface 42 abuts against a side surface of the cutting blade 14 (side surface opposite from the side abutting against the sandwiching surface 23). In this state, the external thread 28 at the front end of the boss portion 25 projects to the front surface side of the fixing flange 40, and the fixing flange 40 is fixed to the blade mounter 20 by screwing and fastening an annular fixing nut 45 onto the external thread 28.

The cutting blade 14 is thus sandwiched between the sandwiching surface 23 of the blade mounter 20 and the sandwiching surface 42 of the fixing flange 40. The outside diameter of the cutting blade 14 is larger than the respective outside diameters of the flange 22 of the blade mounter 20 and the fixing flange 40, so that the outer circumferential portion of the cutting blade 14 projects radially outward of the blade mounter 20 and the fixing flange 40 (see FIG. 2 and FIG. 6).

A rotary joint 50 is mounted on an end portion of the spindle housing 11. The rotary joint 50 includes a cylindrical supporting tube 51 and an attachment plate 52 projecting radially outward from the supporting tube 51. Attachment screws 53 (see FIG. 1 and FIG. 2) inserted through a plurality of screw insertion holes (not depicted) formed in the attachment plate 52 are screwed and fastened into screw holes 17 (see FIG. 1) formed in the end portion of the spindle housing 11. The rotary joint 50 is thereby fixed to the spindle housing 11. The supporting tube 51 is provided with a cylindrical portion 55 projecting radially outward. A communicating passage 56 is formed within the cylindrical portion 55. One end of the communicating passage 56 opens to an inner circumferential surface of the supporting tube 51. Another end of the communicating passage 56 opens to an end of the cylindrical portion 55.

Figure 4:
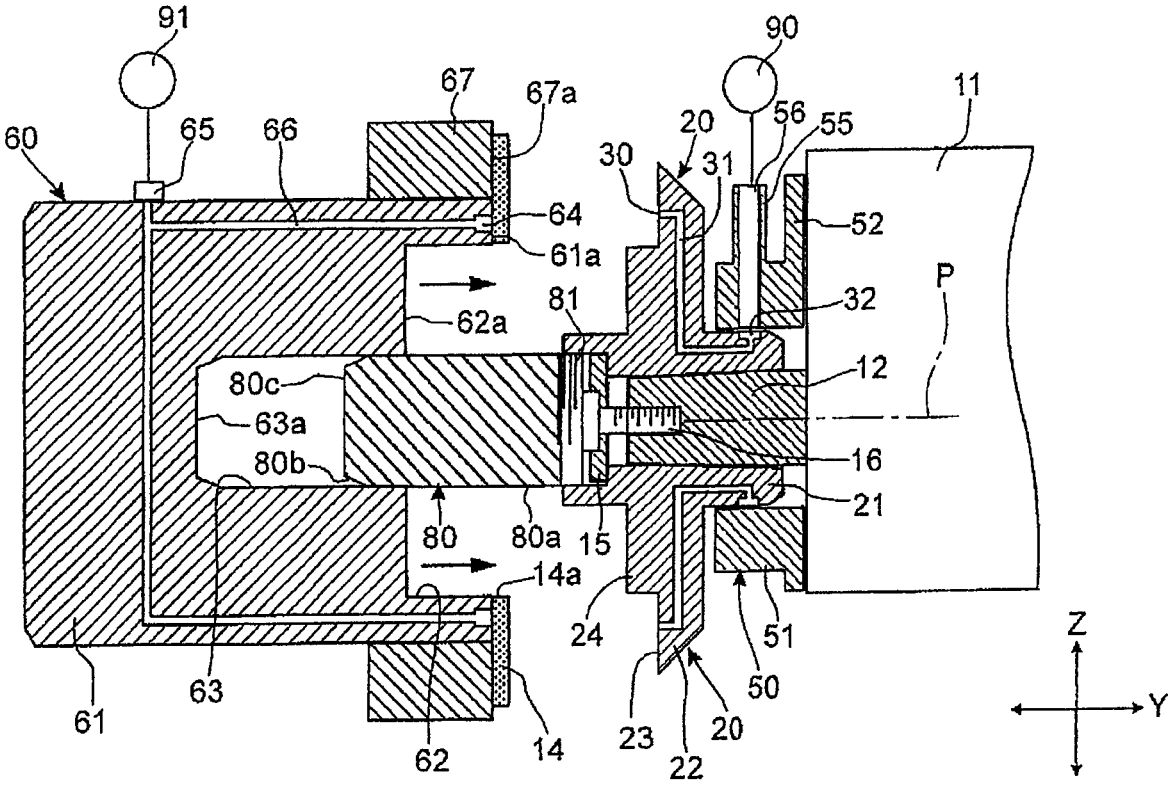
FIG. 4 is a sectional view depicting a cutting blade provisional holding step.
Figure 5:
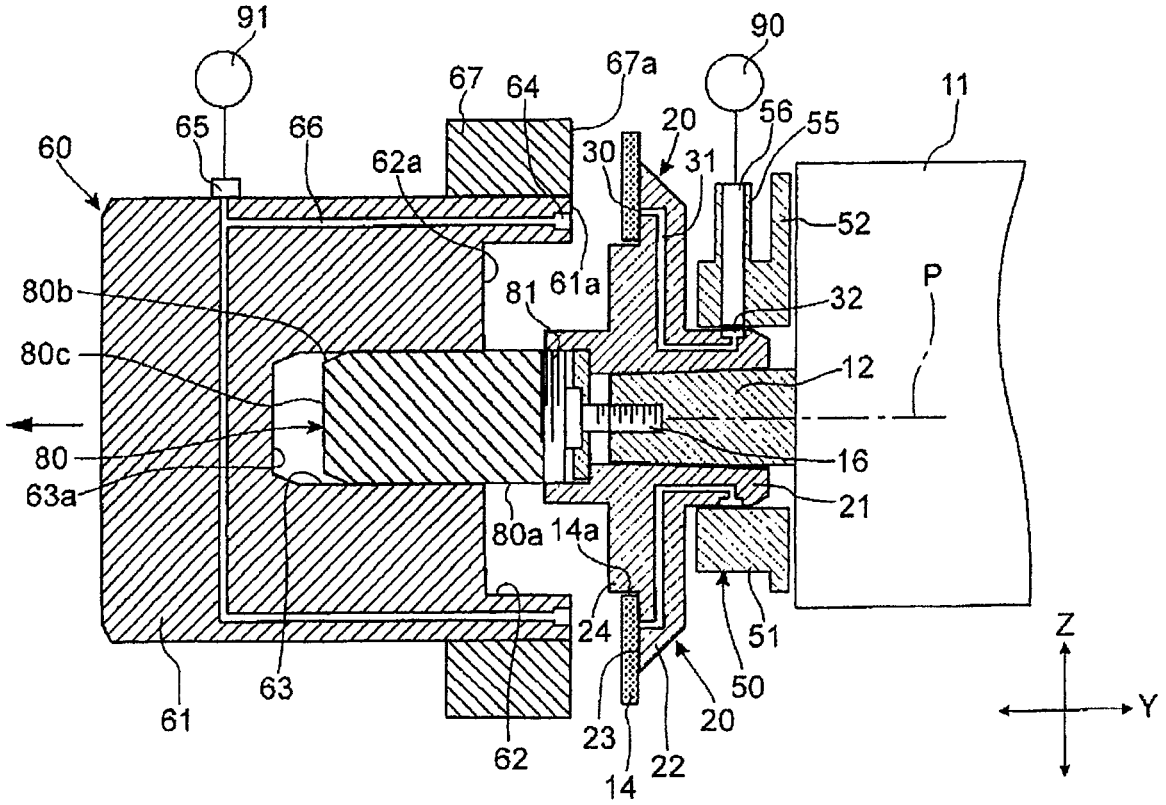
FIG. 5 is a sectional view depicting the cutting blade provisional holding step.

The rotary joint 50 is attached to the spindle housing 11 before the blade mounter 20 is mounted onto the spindle 12. When the blade mounter 20 is mounted onto the spindle 12, the cylindrical portion 21 is rotatably inserted into the inside of the supporting tube 51. As depicted in FIG. 6, in a state in which the cylindrical portion 21 is inserted in the supporting tube 51, the annular groove 32 communicates with the communicating passage 56. Because the annular groove 32 is formed over the whole circumference of the cylindrical portion 21, the annular groove 32 and the communicating passage 56 maintain the communicating state at all times even when the blade mounter 20 is at any position in a rotational direction with respect to the rotary joint 50. That is, in a state in which the blade mounter 20 is mounted on the spindle 12, a suction passage is formed which continues from the suction holes 30 through the suction passages 31 and the annular groove 32 to the communicating passage 56. As depicted in FIGS. 4 to 6, a suction pipe passage extending from a suction source 90 is connected to the cylindrical portion 55. When the suction source 90 is driven, an air can be sucked from the suction holes 30 through the above-described suction passage. Incidentally, the inner circumferential surface of the supporting tube 51 covers parts of the annular groove 32 other than a part thereof opposed to the communicating passage 56. Thus, no air leakage occurs in the middle of the suction passage, so that suction efficiency is not impaired.

A mounting jig used for mounting the cutting blade 14 onto the blade mounter 20 will next be described. The mounting jig includes a blade holding jig 60, a blade loading jig 70, and a mounting guiding jig 80.

As depicted in FIGS. 3 to 5, the blade holding jig 60 has a main body portion 61 of a cylindrical shape, and one end surface of the main body portion 61 is a suction surface 61*a*, which is an annular flat surface that can abut against a side surface of the cutting blade 14. A large-diameter recessed portion 62 and a small-diameter recessed portion 63 are formed within the main body portion 61. The large-diameter recessed portion 62 is a recessed portion having a cylindrical inner circumferential surface, and opens to an inside in a radial direction of the suction surface 61*a*. The small-diameter recessed portion 63 is recessed from a bottom surface 62*a* of the large-diameter recessed portion 62, and is a recessed portion having a cylindrical inner circumferential surface of a smaller diameter than the large-diameter recessed portion 62. The small-diameter recessed portion 63 has a bottom surface 63*a* parallel with the suction surface 61*a*. The inner circumferential surface of the large-diameter recessed portion 62 and the inner circumferential surface of the small-diameter recessed portion 63 are arranged concentrically. The suction surface 61*a* is an annular surface concentric with the large-diameter recessed portion 62 and the small-diameter recessed portion 63.

A suction hole 64 is formed on the suction surface 61*a*. The suction hole 64 is an annular hole concentric with the suction surface 61*a*. A connecting portion 65 to which a suction pipe passage extending from a suction source 91 is connected is provided on a side surface of the main body portion 61. A suction passage 66 that makes the suction hole 64 and the connecting portion 65 communicate with each other is formed within the main body portion 61. The suction passage 66 includes an annular part connected to the suction hole 64 and surrounding the large-diameter recessed portion 62 and the small-diameter recessed portion 63 and a part connected to the connecting portion 65 and extending in the radial direction of the main body portion 61.

An annular auxiliary portion 67 is mounted on the outside of the main body portion 61 of the blade holding jig 60. The annular auxiliary portion 67 is an annular body surrounding an outer circumferential surface of the main body portion 61. The annular auxiliary portion 67 has an annular surface 67*a* that becomes flush with the suction surface 61*a* in a state in which the annular auxiliary portion 67 is mounted on the main body portion 61. A plurality of kinds of annular auxiliary portions 67 whose annular surface 67*a* has different diameters are prepared. An annular auxiliary portion 67 of an appropriate size is selected according to a difference in the diameter of the cutting blade 14 to be mounted onto the blade mounter 20, and is mounted onto the main body portion 61. Specifically, a setting is made such that the suction surface 61*a* and the annular surface 67*a* can support the whole side surface on one side of the cutting blade 14 (see FIG. 4).

As depicted in FIG. 3, the blade loading jig 70 includes a disk-shaped base portion 71 as well as a regulating portion 72 and a guiding projecting portion 73 that project from the base portion 71. The base portion 71 has a blade supporting surface 71*a*, which is an annular flat surface on which a side surface of the cutting blade 14 can be mounted. The regulating portion 72 projects from the blade supporting surface 71*a*. Formed on an external surface of the regulating portion 72 are a regulating surface 72*a* as a cylindrical surface having a diameter corresponding to the inside diameter of the circular opening 14*a* of the cutting blade 14, a tapered surface 72*b* as a side surface of a circular truncated cone which surface is continuous with the regulating surface 72*a*, and an insertion regulating surface 72*c* as an upper surface of the circular truncated cone. The insertion regulating surface 72*c* is a plane parallel with the blade supporting surface 71*a*. The guiding projecting portion 73 is a cylindrical projection projecting from the insertion regulating surface 72*c*. Formed on an external surface of the guiding projecting portion 73 are an insertion guiding surface 73*a* as a cylindrical surface concentric with the regulating surface 72*a* and a tapered surface 73*b* as a side surface of a circular truncated cone which surface is continuous with the insertion guiding surface 73*a*.

As depicted in FIG. 3, the regulating portion 72 and the guiding projecting portion 73 of the blade loading jig 70 can be inserted into the large-diameter recessed portion 62 and the small-diameter recessed portion 63 of the blade holding jig 60. The regulating surface 72*a* of the regulating portion 72 has a diameter corresponding to the inside diameter of the large-diameter recessed portion 62. The insertion guiding surface 73*a* of the guiding projecting portion 73 is of a smaller diameter than the regulating surface 72*a*, and has a diameter corresponding to the inside diameter of the small-diameter recessed portion 63. Insertion of the blade loading jig 70 into the blade holding jig 60 is restricted at a position at which the insertion regulating surface 72*c* abuts against the bottom surface 62*a* (see FIG. 3). In this insertion restricted state, the suction surface 61*a* and the annular surface 67*a* on the blade holding jig 60 side are opposed to the blade supporting surface 71*a* on the blade loading jig 70 side with a predetermined gap (slightly larger than the thickness of the cutting blade 14) therebetween. In addition, the regulating surface 72*a* is located on a side of a part where the suction surface 61*a* and the blade supporting surface 71*a* are opposed to each other.

As depicted in FIG. 4 and FIG. 5, the mounting guiding jig 80 has a cylindrical shape similar to that of the guiding projecting portion 73 of the blade loading jig 70. Formed on an external surface of the mounting guiding jig 80 are an insertion guiding surface 80*a* as a cylindrical surface, a tapered surface 80*b* as a side surface of a circular truncated cone which surface is continuous with the insertion guiding surface 80*a*, and an insertion regulating surface 80*c* as an upper surface of the circular truncated cone. The mounting guiding jig 80 can be inserted into the small-diameter recessed portion 63 of the blade holding jig 60. The insertion guiding surface 80*a* has a diameter corresponding to the inside diameter of the small-diameter recessed portion 63. An external thread 81 is formed on a base end of the mounting guiding jig 80. The external thread 81 can be screwed into the internal thread 29 formed in the boss portion 25 of the blade mounter 20.

The blade holding jig 60, the blade loading jig 70, and the mounting guiding jig 80 are each a rigid body formed of stainless steel or the like. The blade holding jig 60, the blade loading jig 70, and the mounting guiding jig 80 each have a high shape precision, and can be combined with each other with high precision without occurrence of a backlash or the like. Therefore, in a state in which the blade holding jig 60 and the blade loading jig 70 are combined with each other as in FIG. 3, or in a state in which the blade holding jig 60 and the mounting guiding jig 80 are combined with each other as in FIG. 4 and FIG. 5, the jigs can be coupled to each other and slid with respect to each other with high precision. Specifically, the blade holding jig 60 and the blade loading jig 70 are capable of relative movement in a direction along a central axis of the guiding projecting portion 73, and the blade holding jig 60 and the mounting guiding jig 80 are capable of relative movement in a direction along a central axis of the mounting guiding jig 80.

Incidentally, in the present embodiment, an inner surface of the small-diameter recessed portion 63 of the blade holding jig 60 is a cylindrical surface, and the external surface of the guiding projecting portion 73 of the blade loading jig 70 and the external surface of the mounting guiding jig 80 to be inserted into the small-diameter recessed portion 63 are respectively the insertion guiding surface 73*a* and the insertion guiding surface 80*a* having a cylindrical shape. However, shapes other than the cylindrical surfaces (shapes such as an angular hole and a prism as an example) can also be selected as long as the shapes can guide the jigs so as to be capable of relative movement as described above.

Description will be made of work of mounting the cutting blade 14 using the mounting jig described above. In a stage before the cutting blade 14 is mounted, the blade mounter 20 side is in a state depicted in FIG. 4. That is, the blade mounter 20 is mounted on the spindle 12, and the rotary joint 50 is attached to the spindle housing 11, so that a suction force from the suction source 90 acts on the suction holes 30 through the communicating passage 56, the annular groove 32, and the suction passages 31. The fixing flange 40 has been removed from the blade mounter 20. In addition, the mounting guiding jig 80 is mounted onto the blade mounter 20 by screwing the external thread 81 into the internal thread 29 before attachment of the cutting blade 14 to the blade mounter 20 which attachment will be described later.

First, the cutting blade 14 is attached to the blade loading jig 70. More specifically, the circular opening 14*a* of the cutting blade 14 is inserted from the guiding projecting portion 73 side. The inner circumferential portion of the circular opening 14*a* is inserted while guided by the tapered surface 72*b*. The insertion is regulated when the circular opening 14*a* moves to a position where a side surface of the cutting blade 14 abuts against the blade supporting surface 71*a* (position depicted in FIG. 3). In this state, the position of the inner circumferential portion of the circular opening 14*a* is regulated by the regulating surface 72*a*. The position regulated by the regulating surface 72*a* corresponds to a perfect circle position at which the center of the cutting blade 14 coincides with the axis P of the spindle when the cutting blade 14 is finally mounted on the blade mounter 20.

Next, as depicted in FIG. 3, the blade holding jig 60 is mounted onto the blade loading jig 70 in a state of supporting the cutting blade 14. When the blade holding jig 60 is mounted onto the blade loading jig 70, the guiding projecting portion 73 is inserted into the small-diameter recessed portion 63. The insertion can be performed smoothly due to the tapered surface 73*b* formed on the guiding projecting portion 73. When the insertion proceeds, the regulating portion 72 advances into the large-diameter recessed portion 62. The insertion is regulated when the insertion regulating surface 72*c* abuts against the bottom surface 62*a*. In this stage, there is a minute gap between a side surface of the cutting blade 14 supported on the blade supporting surface 71*a* (side surface opposite from the side supported by the blade supporting surface 71*a*) and the suction surface 61*a* and the annular surface 67*a*. There is thus no fear of damaging the cutting blade 14 due to a load.

When combination of the blade holding jig 60 and the blade loading jig 70 with each other is completed as in FIG. 3, the suction source 91 is driven to make a suction force act on the suction hole 64. The suction causes the side surface of the cutting blade 14 (side surface opposite from the side supported by the blade supporting surface 71*a*) to be sucked and held by the suction surface 61*a* and the annular surface 67*a*. In stages before the cutting blade 14 is sucked and held on the blade holding jig 60 side (a step of mounting the cutting blade 14 onto the blade loading jig 70 and a step of mounting the blade holding jig 60 onto the blade loading jig 70), it is preferable to direct the base portion 71 downward, and insert the cutting blade 14 and the blade holding jig 60 onto the blade loading jig 70 in a vertical direction, as depicted in FIG. 3. It is thereby possible to prevent positional displacement and falling off of the cutting blade 14.

When the cutting blade 14 is sucked and held by the suction surface 61*a* and the annular surface 67*a*, the blade loading jig 70 is removed from the blade holding jig 60. The cutting blade 14 is sucked and held on the blade holding jig 60 side while continuing maintaining a radial direction position (perfect circle position) regulated by the regulating surface 72*a* in the above-described stage of mounting the cutting blade 14 onto the blade loading jig 70. In other words, a state is maintained in which the center of the annular cutting blade 14 coincides with the central axis of the large-diameter recessed portion 62 and the small-diameter recessed portion 63 of the blade holding jig 60.

Next, as depicted in FIG. 4, the small-diameter recessed portion 63 of the blade holding jig 60 in the state of sucking and holding the cutting blade 14 is inserted onto the mounting guiding jig 80 mounted on the blade mounter 20. The insertion can be performed smoothly due to the tapered surface 80*b* formed on the mounting guiding jig 80. Incidentally, although the blade holding jig 60 is mounted onto the mounting guiding jig 80 in a state of being laid sideways with respect to the Z-axis direction as the vertical direction (see FIG. 4), positional displacement and falling off of the cutting blade 14 do not occur because the cutting blade 14 is held by the suction force acting on the suction hole 64.

When the blade holding jig 60 is inserted onto the mounting guiding jig 80, a side surface of the cutting blade 14 (side surface opposite from the side sucked by the suction surface 61*a*) approaches the sandwiching surface 23 of the blade mounter 20. At this time, the cutting blade 14 maintains the above-described radial direction position (perfect circle position) set by the regulating surface 72*a* of the blade loading jig 70. The cutting blade 14 can therefore approach the sandwiching surface 23 in a positional relation such that the flange portion 24 of the blade mounter 20 fits into the inside of the circular opening 14*a* without the cutting blade 14 interfering with the flange portion 24.

The blade holding jig 60 is inserted until the cutting blade 14 abuts against the sandwiching surface 23 of the blade mounter 20. Incidentally, to prevent the blade mounter 20 and the blade holding jig 60 from applying an excessive sandwiching force to the cutting blade 14 at this time, movement in the insertion direction of the blade holding jig 60 may be regulated by abutment between the insertion regulating surface 80*c* of the mounting guiding jig 80 and the bottom surface 63*a* of the small-diameter recessed portion 63. In this case, a setting is made such that a distance between the suction surface 61*a* and the annular surface 67*a* and the sandwiching surface 23 coincides with the thickness of the cutting blade 14 in a stage in which the insertion regulating surface 80*c* and the bottom surface 63*a* abut against each other.

Next, when the suction source 90 is driven to make a suction force act on the suction holes 30, a force for sucking the side surface of the cutting blade 14 acts on the sandwiching surface 23 of the blade mounter 20. Then, when the suction force on the blade holding jig 60 side (suction and holding to the suction surface 61*a* and the annular surface 67*a*) is released by stopping driving the suction source 91, the cutting blade 14 is sucked and held by the sandwiching surface 23. That is, switching is performed from a state in which the cutting blade 14 is held on the blade holding jig 60 side to a state in which the cutting blade 14 is held on the blade mounter 20 side.

The blade holding jig 60 is pulled out from the mounting guiding jig 80 as depicted in FIG. 5 while the state in which the cutting blade 14 is sucked and held by the sandwiching surface 23 is maintained. When the blade holding jig 60 is pulled out, the driving of the suction source 90 is continued, and the suction force acting on the sandwiching surface 23 continues to hold the cutting blade 14 on the blade mounter 20 side. The cutting blade 14 at this time continues to maintain the radial direction position (perfect circle position) regulated by the regulating surface 72*a* in the above-described stage of mounting the cutting blade 14 onto the blade loading jig 70, and the center of the cutting blade 14 coincides with the spindle axis P of the spindle 12.

The above stages constitute a cutting blade provisional holding step of provisionally holding the cutting blade 14 on the blade mounter 20. As described above, in the cutting blade provisional holding step, the holding of the cutting blade 14 is handed over from the blade loading jig 70 to the blade holding jig 60 and then to the blade mounter 20 in this order. However, in each of the stages, the central position of the cutting blade 14 which central position is first regulated by the regulating surface 72*a* of the blade loading jig 70 is maintained without being displaced, and the cutting blade 14 can be provisionally held in a state in which the center of the cutting blade 14 coincides with the spindle axis P of the spindle 12. That is, perfect circle setting of the cutting blade 14 is completed in the provisional holding stage.

Finally, as depicted in FIG. 6, the fixing flange 40 is mounted by inserting the fitting hole 41 onto the boss portion 25 of the blade mounter 20, and a fixing step is performed which fixes the fixing flange 40 by screwing the fixing nut 45 onto the external thread 28. When the fixing step is performed, a fixed state is obtained in which both side surfaces of the cutting blade 14 are sandwiched by the sandwiching surface 23 and the sandwiching surface 42, and movement of the cutting blade 14 in each of the X-axis, Y-axis, and Z-axis directions with respect to the spindle 12 is restricted. The driving of the suction source 90 is stopped after the fixing of the fixing flange 40. The cutting blade 14 is already fixed by sandwiching. Thus, even when the suction force from the suction holes 30 is released, positional displacement and falling off of the cutting blade 14 do not occur.

As described above, according to the cutting blade mounting method in accordance with the present embodiment, the blade mounter 20 holds the cutting blade 14 at the perfect circle position at which the center of the cutting blade 14 coincides with the spindle axis P of the spindle 12 in the cutting blade provisional holding step, and the fixing step of fixing the fixing flange 40 is performed while the perfect circle position of the cutting blade 14 is maintained by suction. Eccentricity or the like of the cutting blade 14 due to the own weight of the cutting blade 14 does not occur during mounting, and a proper perfect circle position is achieved in a state in which the mounting of the new cutting blade 14 is completed. Hence, processing can be performed immediately by saving a time taken for perfect circle dressing and setting dressing after mounting the cutting blade 14, so that processing efficiency of the cutting apparatus can be improved. Incidentally, the mounting of the cutting blade to which the present invention is applied may be performed by an auto blade changer that automatically replaces the cutting blade, or may be performed by blade replacement by manual operation of an operator.

The blade mounter 20 and the fixing flange 40 used to hold the cutting blade 14 and the mounting jig (the blade holding jig 60, the blade loading jig 70, and the mounting guiding jig 80) used at the time of mounting the cutting blade 14 can adopt configurations different from those of the present embodiment.

For example, the configuration of the suction structure provided to the blade mounter 20 may be changed as long as the suction structure can surely suck and hold the cutting blade 14 in the cutting blade provisional holding step. Specifically, while the plurality of suction holes 30 are provided at predetermined intervals on the sandwiching surface 23 of the blade mounter 20 in the present embodiment, a continuous annular suction hole (hole in a form such as that of the suction hole 64 of the blade holding jig 60) may be provided in place of the plurality of suction holes 30.

As target workpiece to be cut by the cutting blade mounted by applying the present invention, various kinds of workpiece may be used, such as a semiconductor device wafer, an optical device wafer, a package substrate, a semiconductor substrate, an inorganic material substrate, an oxide wafer, a raw ceramic substrate, a piezoelectric substrate, and the like. A silicon wafer or a compound semiconductor wafer after the formation of devices may be used as the semiconductor device wafer. A sapphire wafer or a silicon carbide wafer after the formation of devices may be used as the optical device wafer. In addition, a chip size package (CSP) substrate may be used as the package substrate, silicon, gallium arsenide, or the like may be used as the semiconductor substrate, and sapphire, ceramics, glass, or the like may be used as the inorganic material substrate. Further, lithium tantalate or lithium niobate after the formation of devices or before the formation of devices may be used as the oxide wafer.

In addition, the embodiment of the present invention is not limited to the foregoing embodiment and modifications, but may be changed, replaced, and modified in various manners without departing from the spirit of technical ideas of the present invention. Further, when a technical idea of the present invention can be realized in a different manner by progress of a technology or another derived technology, the technical idea of the present invention may be carried out by using the method. Hence, the claim covers all embodiments that can be included within the scope of the technical ideas of the present invention.

As described above, according to the cutting blade mounting method in accordance with the present invention, perfect roundness of the cutting blade with respect to the spindle at a point in time of completion of mounting of the new cutting blade is ensured. Thus, productivity can be improved by shortening a time taken before the cutting blade is mounted and becomes able to perform processing.

The present invention is not limited to the details of the above described preferred embodiment. The scope of the invention is defined by the appended claim and all changes and modifications as fall within the equivalence of the scope of the claim are therefore to be embraced by the invention.

What is claimed is:

1. A cutting blade mounting method of sandwiching both side surfaces of a cutting blade formed by an annular cutting edge by sandwiching surfaces of a first flange and a second flange, and mounting the cutting blade onto a spindle, the first flange being mounted on an end of the spindle and having a suction hole sucking and holding a side surface of the cutting blade to the sandwiching surface, the cutting blade mounting method comprising:

a cutting blade provisional holding step of sucking and holding the cutting blade to the first flange by making the cutting blade abut against the sandwiching surface of the first flange at a perfect circle position at which a center of the cutting blade coincides with an axis of the spindle, and making a suction force act on the suction hole; and a fixing step of fixing the cutting blade maintaining the perfect circle position to the first flange by the second flange after the cutting blade provisional holding step is performed.

2. The cutting blade mounting method according to claim 1, wherein the cutting blade provisional holding step further comprises:

a loading step of loading the cutting blade onto a blade loading jig by inserting a tapered guiding projecting portion projecting from a base through an opening of the cutting blade, making a side surface of the cutting blade abut against a blade supporting surface of the blade loading jig at the perfect circle position;

an inserting step of inserting the tapered guiding projection portion of the blade loading jig into a recessed portion of a blade holding jig, making an insertion regulating surface of the blade loading jib abut against a bottom surface of the blade holding jig;

a sucking step of sucking and holding the cutting blade to the blade holding jig by making a suction force act on a second suction hole while maintaining the perfect circle position; and a mounting step of mounting the blade holding jig onto a mounting guiding jig, by inserting a tapered surface of the mounting guiding jig into the recessed portion of the blade holding jig, making the side surface of the cutting blade abut against the first flange while maintaining the perfect circle position.

* * * * *